United States Patent [19]

Gillilan et al.

[11] 3,941,509

[45] Mar. 2, 1976

[54] PUMPING SYSTEM

[75] Inventors: James E. Gillilan, Sweetwater, Tex.; Henry M. Townsend, Reedsport, Oreg.

[73] Assignee: Fluid Systems Research, Inc., Winchester Bay, Oreg.

[22] Filed: Aug. 2, 1974

[21] Appl. No.: 494,062

[52] U.S. Cl. ..... 417/54; 417/86; 417/118

[51] Int. Cl.[2] .... F04B 23/14; F04F 1/06; F04F 3/00

[58] Field of Search ..... 417/118, 54, 86, 55

[56] References Cited

UNITED STATES PATENTS

| | | | |
|---|---|---|---|
| 298,990 | 5/1884 | Leedy | 417/118 |
| 868,487 | 10/1907 | Rosengarten | 417/118 |
| 1,102,152 | 6/1914 | Jones | 417/54 |
| 1,227,014 | 5/1917 | Stegall | 417/118 |
| 1,279,580 | 9/1918 | Peters | 417/118 X |
| 3,617,152 | 11/1971 | Cummings | 417/54 |

*Primary Examiner*—C. J. Husar
*Assistant Examiner*—Richard E. Gluck
*Attorney, Agent, or Firm*—Klarquist, Sparkman, Campbell, Leigh, Hall & Whinston

[57] ABSTRACT

Liquid is pumped from a relatively small submerged tank in pumping cycles by discharging a gas at relatively high pressure from a relatively large tank into the submerged tank. When the submerged tank is emptied of liquid, the high pressure gas which fills it is reclaimed by exhausting the same into a second relatively large tank maintained at low pressure. Gas is reclaimed into the second large tank after the next and each subsequent pumping cycle until the resulting pressure differential impedes further transfer. Tanks filled with reclaimed gas are connected to the inlet of the air compressor to reduce the pressure thereacross and lessen the power required to compress the gas required for the pumping.

2 Claims, 1 Drawing Figure

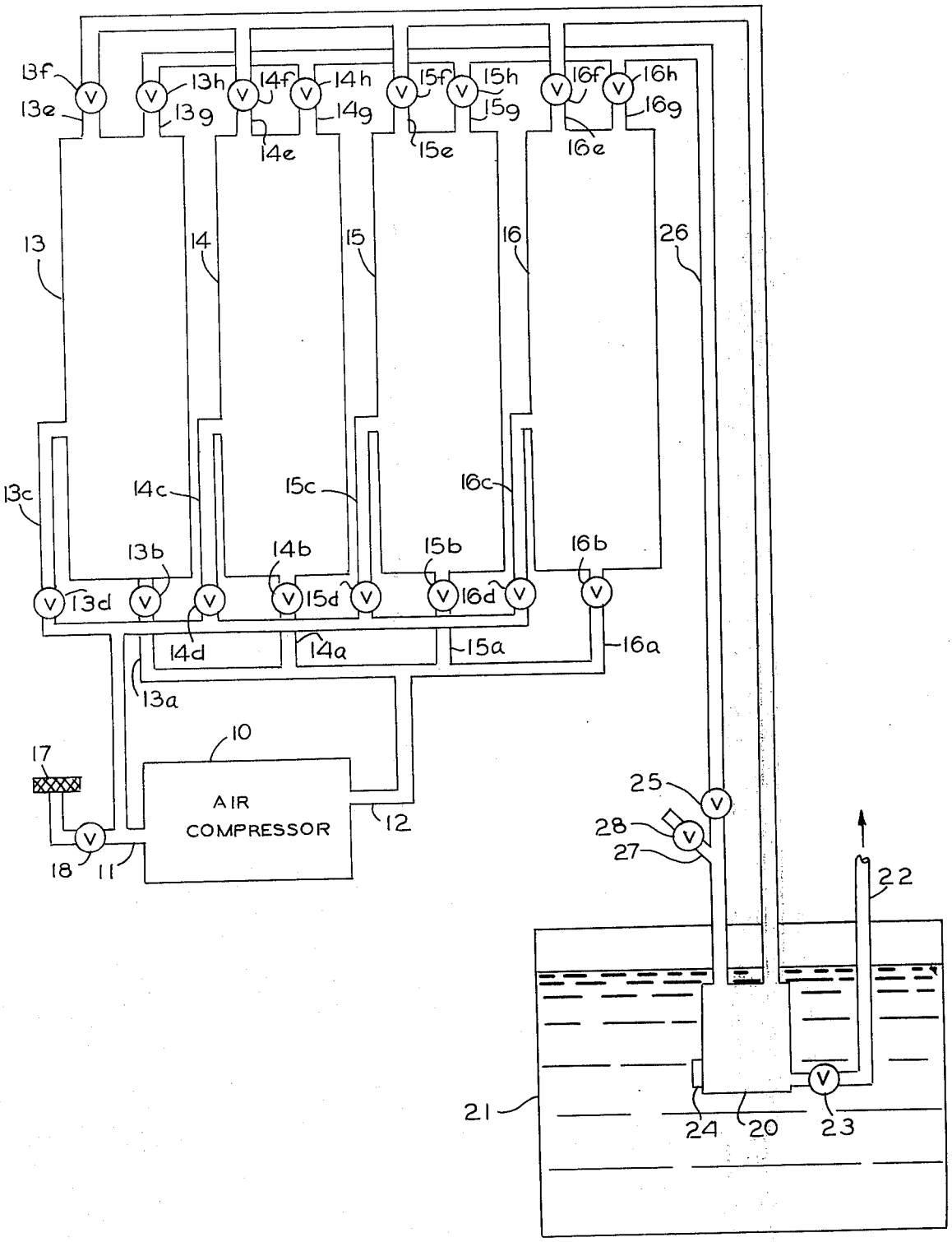
13f
13e
13h
13g
14f
14h
14g
14e
15f
15h
15g
15e
16f
16h
16g
16e
13
14
15
16
26
13c
14c
15c
16c
13b
14b
15b
16b
13d
15d
16d
14d
14a
15a
16a
13a
10
17
AIR
COMPRESSOR
12
18
11
25
28
27
22
21
24
20
23

PUMPING SYSTEM

BACKGROUND OF THE INVENTION

This invention relates to the use of compressed gas in the batch pumping of a liquid and, more particularly, to a method and apparatus for reclaiming the gas used in pumping the liquid by exhausting the gas into receiving tanks separate from the tank used to store the high pressure gas used in the pumping.

It is the primary object of the present invention to provide a method and apparatus for using compressed gas in the batch pumping of liquids wherein portions of the gas used in the pumping can be reclaimed.

It is a further object of the present invention to provide such a method and apparatus wherein the reclaimed gas used in the pumping can be used to minimize the pressure across an air compressor, thereby to lessen the power required to compress the air to the necessary pumping pressure.

Other objects and advantages will be apparent from the following specification when read in conjunction with the drawings which form a part thereof.

SUMMARY OF THE INVENTION

The method of our invention comprises discharging gas from a first relatively large tank filled with gas at a relatively high pressure into a relatively small tank filled with a liquid which is to be pumped, the discharge of gas into the small tank simultaneously pressurizing the same with the gas at the relatively high pressure. When the small tank is emptied of the liquid, the high pressure gas remaining therein is exhausted into a second relatively large tank maintained at a relatively low pressure, thereby to reclaim the gas used in pumping the liquid from the small tank.

The gas used in pumping is reclaimed after each pumping cycle until the pressure increases in the second large tank sufficiently to cause the transfer to become inefficient.

Gas at low pressure in the reclaiming tank may be discharged into the inlet of the air compressor to reduce the pressure head thereacross and effectively lessen the power required to compress the air in the first large or pumping tank.

The apparatus of our invention comprises a gas compressor and a plurality of relatively large gas impervious tanks in communication with the outlet of the compressor. A relatively small gas impervious tank is disposed in communication with each of the relatively large tanks, the relatively small tank being capable of being filled with a liquid to be pumped.

First valve means are provided for discharging gas under relatively high pressure from a selected one of the relatively large tanks into the relatively small tank to force liquid out therefrom against a pressure head and simultaneously to pressurize the small tank with high pressure gas from the selected one of the large tanks.

Second valve means are provided for exhausting the relatively high pressure gas remaining in the small tank back into another one of the relatively large tanks to reclaim the same.

The relatively large tanks are maintained in communication with the inlet of the compressor and third valve means are provided for discharging gas from a selected one of such relatively large tanks into the inlet of the compressor to reduce the head thereacross.

The relatively small tank may desirably be used in the pumping of liquid from a reservoir or other body in which such small tank is submerged. Fourth valve means are then provided for refilling the small tank with liquid from the reservoir after exhausting the gas used in pumping the liquid therefrom.

BRIEF DESCRIPTION OF THE DRAWING

The FIGURE schematically illustrates apparatus for pumping liquid in accordance with the present invention and wherein the small tank is submerged in a reservoir from which liquid is to be pumped therefrom.

DESCRIPTION OF THE PREFERRED EMBODIMENT

As shown in the drawing, the system of the present invention includes an air compressor 10, which may, for example, comprise a reciprocating compressor in which the air is compressed very nearly adiabatically, having an inlet 11 and an outlet 12, and a plurality of relatively large, gas impervious pumping and reclaiming tanks 13, 14, 15 and 16, four of the same being illustrated herein, each of which has, for example, a capacity of 1250 cubic feet. The tanks 13, 14, 15 and 16 are connected to the compressor outlet 12 by lines 13*a*, 14*a*, 15*a* and 16*a*, respectively, as shown, in which are disposed valves 13*b*, 14*b*, 15*b* and 16*b*, respectively. The tanks are further connected to the compressor inlet 11 by lines 13*c*, 14*c*, 15*c* and 16*c*, respectively, in which are disposed valves 13*d*, 14*d*, 15*d* and 16*d*, respectively. The compressor inlet 11 is provided with an air intake filter 17 and an intake valve 18.

The system further includes a relatively small gas impervious tank 20, which may, for example, have a capacity of 50 cubic feet, and, when the system is used in the batch pumping of a liquid from a reservoir 21, is disposed in the water in the reservoir and is provided with a discharge line 22 having a valve 23. The tank is further provided with a filling valve 24, as shown.

The pumping and reclaiming tanks 13, 14, 15 and 16 are connected to the small tank 20 by lines 13*e*, 14*e*, 15*e* and 16*e*, respectively, in which are disposed valves 13*f*, 14*f*, 15*f* and 16*f*, respectively, as shown. The tanks 13, 14, 15 and 16 are further connected to the tank 20 by reclaim lines 13*g*, 14*g*, 15*g* and 16*g*, respectively, in which are disposed valves 13*h*, 14*h*, 15*h* and 16*h*, respectively. An additional valve 25 is provided in a main reclaim line 26, which is further provided with an air vent 27 having a valve 28.

Operation

In the pumping of water from the reservoir 21 against a pressure head as, for example, to a higher level through the discharge line 22, the compressed air pumping and reclaiming tanks 13, 14, 15 and 16 are initially pressurized, for example, with compressed air to pressures of atmospheric pressure, 50 psi, 50 psi and 150 psi, respectively. The cycle is initiated with the submerged tank 20 filled to approximately 90 percent capacity with water from the reservoir 21 and with all valves closed.

To pump the water out of the tank 20, the valve 16*f* in the line 16*e* is opened to pressurize the tank 20 from the tank 16, and with the air compressor 10 operating to maintain the 150 psi pressure in the tank 16 through the valve 16*b* in the line 16*a*, the valve 23 in the discharge line 22 is opened to permit water to flow therethrough at a velocity which will be determined by the applied pressure, the head to be overcome and the line friction losses. Compressed air thus flows from the tank 16 into the tank 20 until the latter is emptied, whereupon the valve 23 is closed. The tank 20 is then pressurized with the high pressure air (150 psi) from the tank 16.

The valve 16*f* is then closed and the valves 13*h* and 25 are then opened to permit the high pressure air in the tank 20 to flow through the lines 26 and 13*g* into the tank 13, which is at atmospheric pressure. Practically all of the compressed air in the tank 20 is exhausted into the reclaiming tank 13 because of the tremendous difference in pressure and size therebetween. When the pressure between the tanks 13 and 20 is balanced, the valves 13*h* and 25 are closed, and the valves 24 and 28 are opened to refill the tank 20. The head of water in the reservoir 21 refills the tank 20, exhausting all residual air through the valve 28, whereupon the valves 24 and 28 are closed, preparing the tank 20 for repressurizing and another pumping cycle.

Pumping cycles can continue until the pressure differential between the tanks 13 and 20 is reduced to a point that impedes further transfer of air, as, for example, until the tank 13 is pressurized to 50 psi. At this point, another tank, either one of tanks 14 or 15, is used for reclaiming the air used in pumping.

To achieve increased efficiency in the operation of the compressor 10, a tank, for example tank 14, pressurized with reclaimed air to 50 psi, is connected to the inlet 11 of the compressor through valve 14*d* in line 14*c*, thereby to reduce the pressure across the compressor and reduce the power required to maintain the high pressure in the tank being filled, for example, tank 16. Once the tank 14 so connected is exhausted to approximately atmospheric pressure, it is connected to the tank 20 as above described for partial repressurization. Using the minimum working pressure, for example 50 psi as noted above, applied to the inlet 11 of the compressor 10, markedly lessens the power required to compress the air in the high pressure tank 16. All tanks, after reaching the predetermined efficiency decline point in reclaiming, can be pumped to the maximum pressure, 150 psi in the instant example, by the air compressor 10 as required to maintain the pumping activity. Controlled rotation of the use of each tank can maintain appropriate balance therebetween, thus to maintain one or more of the tanks 13, 14, 15 and 16 continually ready to operating the tank 20.

Pumping between tanks by connection of a tank at low pressure to the compressor inlet 11 may be either an intermittent or a continuous operation, depending on the physical characteristics of the system. A typical system will make it possible to reclaim approximately 70 percent of the air actually used in pumping, leaving approximately 30 percent of the compressed air required to be compressed directly from atmospheric pressure. To eliminate thermal inefficiency, compression of the air is done isothermally, as, for example, by use of water cooling jackets to cool the air before entering a receiving tank.

As an example of the power saving obtained by discharging reclaimed air into the compressor inlet 11, it is noted that for adiabatic compression the power required to compress, for example, a given quantity of air from 25 psig to 100 psig is less than half that required to compress the same quantity of air from atmospheric pressure to 100 psig. Corresponding savings are obtainable at every level of reclaimed pressure.

We claim:

1. In the use of a compressed gas in pumping a liquid against a pressure head, the improvement comprising the steps of:

a. compressing a gas using a compressor to a first predetermined relatively high superatmospheric pressure in a first relatively large tank;

b. discharging said gas from said first relatively large tank into a relatively small tank filled with a liquid to force said liquid out of said small tank against a pressure head and simultaneously to pressurize said small tank with said relatively high pressure gas from said first tank;

c. exhausting said relatively high pressure gas from said small tank into a second relatively large tank filled with gas at a substantially lesser pressure than said gas in said first relatively large tank to reclaim said gas in said small tank;

d. refilling said small tank with liquid and repeating steps b and c until said second relatively large tank is brought to a second predetermined superatmospheric pressure less than said pressure maintained in said first relatively large tank; and then e. connecting said second relatively large tank to the inlet of said compressor to reduce the pressure head thereacross and thereby reduce the power required to compress said gas in said first relatively large tank to said first predetermined relatively high superatmospheric pressure.

2. The improvement of claim 1 further comprising exhausting said relatively high pressure gas from said small tank into a third relatively large tank filled with gas at a substantially lesser pressure than said gas in said first relatively large tank while said second relatively large tank is connected to said inlet of said compressor.

* * * * *